US006096103A

United States Patent [19]

Hubbard et al.

[11] Patent Number: 6,096,103

[45] Date of Patent: Aug. 1, 2000

[54] ALTERNATIVE FUEL FOR USE IN A DIESEL ENGINE-POWERED EMERGENCY GENERATOR FOR INTERMITTENT USE IN FIXED INSTALLATIONS

[75] Inventors: William A. Hubbard, Timonium; Reginald N. Spencer, Towson, both of Md.

[73] Assignee: Leonard Bloom, Towson, Md.; (part interest)

[21] Appl. No.: 09/325,096

[22] Filed: Jun. 3, 1999

[51] Int. Cl.[7] ..... C10L 1/08; C10L 1/10

[52] U.S. Cl. ..... 44/300

[58] Field of Search ..... 44/300

[56] References Cited

U.S. PATENT DOCUMENTS

| | | | |
|---|---|---|---|
| 5,389,111 | 2/1995 | Nikanjam et al. | 44/300 |
| 5,389,112 | 2/1995 | Nikanjam et al. | 44/300 |
| 5,792,339 | 8/1998 | Russell | 44/300 |
| 5,853,433 | 12/1998 | Spencer et al. | 44/300 |

FOREIGN PATENT DOCUMENTS 08157839 12/1994 Japan .

*Primary Examiner*—Jacqueline V. Howard
*Attorney, Agent, or Firm*—Leonard Bloom

[57] ABSTRACT

A special fuel is formulated for use with diesel engines which are used infrequently in emergency situations.

6 Claims, No Drawings

ALTERNATIVE FUEL FOR USE IN A DIESEL ENGINE-POWERED EMERGENCY GENERATOR FOR INTERMITTENT USE IN FIXED INSTALLATIONS

FIELD OF THE INVENTION

The herein disclosed invention finds applicability in the field of diesel fuels, and more particularly to be used for standby diesel motors or engines to power electric generators.

BACKGROUND OF THE INVENTION

Well known in the art are diesel engine-powered electrical generators in fixed installations, which function occasionally in emergency situations when the primary supply of electricity is disrupted as, for example, by storm or by high wind. These diesel motors or engines power generators which generate electricity in emergency situations, such as for hospitals to supply light and power to emergency rooms. More and more malls and banks are depending upon diesel motors to power generators when the electricity is cut-off. At times the cut-off of electricity is long and businesses depending on computers can ill afford to be shut down because of loss of electricity. In view of these facts, it is important to have efficiently operating diesel motors to power electric generators.

Special problems involving diesel motors present themselves when starting and running diesel motors which have remained idle for a long period of time. One of the main problems presented is that after standing idle for a long period of time lubrication on moving parts of the motor dissipate leaving the moving parts free of lubricant. This lack of lubrication on moving parts of the diesel motor impedes fast start up of the diesel motor. The diesel fuel of this invention is designed to mitigate the diesel start up problem.

Normal diesel fuel is not suited for the use as an emergency fuel in back-up diesel motors because it is unstable and forms gums and other deposits during long-term storage. This instability is due to the presence in normal diesel fuel of various olefins, free radicals, sulphur compounds and other reactive materials which can polymerize and react to form materials that impede the engine operation by plugging up fuel lines and filters, as well as fuel injection ports. Gasoline is much worse than diesel fuel in this respect but diesel fuels still can cause problems if stored for period of a year or longer. In the case of emergency generators, it is not unusual for a tank of diesel fuel to be partially used and then more fuel added to fill the tank. This means that some of the original fuel is still present and continues to degrade during the further storage.

Prior Art Patents Murakami et al U.S. Pat. No. 5,730,762 teach a diesel fuel of reduced sulfur content which contains an alkyl side chain on the aromatic ring and also contains hetero nitrogen compounds with an alkyl side chain.

Nikanjam et al U.S. Pat. No. 5,389,112 disclose a diesel fuel with low aromatic content and high cetane number. There are controlled amounts of aromatics in the fuel to produce an optimum cetane number as defined by a graph set forth in the patent. The fuel can also have added thereto a cetane improver.

Cook et al U.S. Pat. No. 5,814,109 teach an additive for improving cetane number and/or lubricity of diesel fuel. The additive is prepared by the Fischer-Tropsch hydrocarbon synthesis.

Russell in U.S. Pat. No. 5,792,339 discloses a diesel fuel which minimizes the production of pollutants from vehicles by adjusting the amounts of aromatic compounds in the fuel.

None of the prior art references discloses diesel fuels especially formulated for emergency-use diesel engines.

OBJECTS OF THE INVENTION

An object of this invention is to produce an improved diesel fuel.

A further object is to produce a diesel fuel wherein stand-by diesel motors will start-up and run without problem.

An important object of this invention is to produce a diesel fuel which will remain stable over a long period of time.

A still further object of this invention is to produce a diesel fuel which will be free of microbiological contamination.

SUMMARY OF THE INVENTION

The diesel fuel of this invention is low in odor, with regard to both the odor of the fuel itself and the odor of the exhaust, and in addition the fuel is stable and will not degrade during long periods of storage. Such a fuel would have at least two immediate uses or advantages:

1. Primarily, it would be a satisfactory fuel for long term storage in tanks associated with emergency generators which are used only rarely and for relatively short periods of time.
2. Secondly, when used (albeit intermittently) the premium fuel would be kinder to the environment because it would have a less obnoxious exhaust odor and fuel odor. It would not have the black, smoky exhaust normally associated with diesel engines, since the exhaust emissions would contain a lower level of pollutants as compared with regular diesel emissions. This is a supplementary benefit of the present invention.

Diesel engines which operate very infrequently in emergency situations face some unique fuel problems. Diesel fuel is well known to have stability problems during long term storage. It tends to develop sludge and gums that foul up the fuel system. Also, the fuel tank may be partially emptied during a short period of use and frequently no additional fuel is added. This causes the tank to "breathe" excessively as the temperature changes, thus bringing moist air into the tank. This moisture tends to condense on the walls of the tank causing a buildup of water in the bottom of the tank. This water serves as a breeding ground for bacteria and fungi which thrive in this type of environment. This can cause the formation of slime or sludge which will foul the fuel system. Also, diesel engines are expected to start quickly and easily after a long period of sitting idle. This is especially important for its intended use, namely, powering an emergency electric generator in a fixed installation. A fuel that starts more easily would offer a big advantage. Also, the freezing or gelling point of the fuel is important because the fuel tank may be positioned outside in northern climates where temperatures get very low in winter. Finally, emergency diesel installations of this type will be more acceptable to all concerned if they are environmentally friendly and do not pollute excessively.

The inventors have developed a diesel fuel identified as a "STAND-BY™" Emergency Fuel. The inventors believe that this fuel satisfactorily addresses all of the issues of concern raised above. There are many different compositions that could be used but one that would be satisfactory is as follows:

DESCRIPTION OF THE INVENTION

Representative fuel compositions are as follows:

| | |
|---|---|
| Shell's Sol 142HT (aliphatic) | 75 to 100% vol. |
| Shell's Cyclo Sol 150 (aromatic) | 25 to 0% vol. |
| "Fuel Saver" (Angus Chem.) | 1,000 ppm (a biocide) |
| Anti-wear additive--if needed | As specified |
| Cetane index improver--if needed | As specified |
| Freeze point depressant--if needed | As specified |

The two Shell products named above are mineral spirits with flash Points above 140F. The 142 HT is 99.7% aliphatic while the Cyclo Sol 150 is 99.8% aromatic. Both have a very low sulphur content—in the range 1 to 2 ppm. Typical diesel fuels contain much more sulphur, in the range of 0.05% and above. Typical diesel fuels must have a flash point above 125° F. so these products would be efficient for operating the emergency-use diesel generators. The diesel fuels of this invention deal with and solve the following problems.

1. LONG TERM STORAGE STABILITY: Typical diesel fuels contain a great variety of olefins, sulfur compounds, and cyclic aromatics that are unstable in long term storage and tend to develop gums and sludge over time. The "STAND BY™" formula contains essentially none of the sulphur and olefins and the aromatics, if added, are very stable in storage.
2. BACTERIA AND FUNGI: A biocide, "Fuel Saver™", is added to the "STAND BY" in quantities large enough to kill existing organism with enough left over to kill any new organisms that may be introduced through "breathing" of the tank or through the addition of more fuel. About 250 ppm will handle the initial kill with the remaining 750 ppm in place to take care of any new additions. Other microbiocides known in the art would be acceptable.
3. EASE OF STARTING: Based on three factors, "STAND BY™" offers easier starting. First, the autoignition temperature of the main ingredient, Sol 142HT, is only 452° F. This is a bit lower than ordinary diesel fuels which may run at 465° F. to 470° F. There is no direct correlation between autoignition temperatures and ease of starting because other factors play a part but this offers a slight advantage. Second, "STAND BY™" is extremely fluid as compared with the heavier typical diesel fuel so it is much easier to disperse into a fine mist through the fuel injectors. This makes the fuel droplets smaller so that they heat faster after the compression stroke thus leading to easier starting. Third, "STAND BY™" is more volatile than regular diesel fuel with a 90% distillation range at about 400 F as compared with 550 to 600 F for conventional fuels. This means that the fuel droplets will vaporize much more readily and this vapor/air mixture will burn more readily at the autoignition temperature, making starting easier.
4. FREEZING OR GELLING POINT: Fuel tanks are frequently located outside of a building in an unheated area. This means that the fuel can be chilled to very low temperatures in the northern climates. Typical diesel fuels can become gels at minus 20 to 30 F thus making them unusable. Additives can be used to lower this gel point. However, "STAND BY™" is based on materials that remain liquid at temperatures below minus 40 F and the gel-point can be lowered even further with additives if necessary.
5. ENGINE WEAR: In a diesel fuel, the presence of sulphur compounds helps provide lubrication to the moving parts that come in contact with the fuel and the combustion products. As the sulphur content is decreased, the engine wear increases. In the case of "STAND BY™", the sulphur content is almost nil so that it may be desirable to use a lubricity additive. A number of such products are available and they should be used in accordance with their manufacturer's instructions.
6. CETANE INDEX IMPROVER: A large variety of diesel engines are in use and are currently being offered for use with emergency generators. The cetane requirements vary from engine to engine. It will be possible to produce one or two grades of "STAND BY™" which will meet the great bulk of the needs of the market. A cetane index improver can be considered and added if necessary.
7. ENVIRONMENTAL CONCERNS: Diesel fuels have become famous for their high sulphur content and their foul exhausts. This has led to increasing regulation of their maximum sulphur content. "STAND BY™" is in a very strong position in this regard with the sulphur content in the range of 1 to 2 ppm. Even in the locale of a hospital or private home, the exhaust will not be a problem.

The inventors have solved the above set forth problems by formulating a quality diesel fuel while simultaneously solving the degradation problem by using, as the diesel fuel, mineral spirits that have been refined to eliminate the olefins, sulfur, free radicals and other reactive materials. This provides a fuel that is completely stable in long-term storage while also providing a fuel that is clearer-burning and much lower in odor.

Various mineral spirits could be used in the diesel fuel of this invention and they would have the following properties:

1. They would be refined so as to be essentially free of olefins, sulfur, free radicals and other reactive materials and they would therefore be stable in long-term storage.
2. They would have a flash point consistent with the diesel fuel that they would replace. This would certainly be above 100° F. but it might even be above 140° F. in some cases.
3. They would have a much narrower boiling range than regular diesel fuel and would probably exclude the heavy ends boiling above 475° F. or 500° F. and higher.
4. They would have a cetane rating that would be high enough for normal operation of the engine in which they are to be used. This rating might range from 40 to 60 or even higher.
5. For practical purposes, they would be available at reasonable costs.

Shell Oil and a great many other petroleum refiners produce mineral spirits which could perform as premium diesel fuels. Some of the Shell mineral spirits that could be used are as follows: Sol 340HT, MS 146HT, MS 200HT. All conventional diesel fuels have flash points above 125° F. Sol 142HT has a flash point of 145° F.

All of these are straight-run materials and have not been subjected to a cracking operation. All have been hydrogen treated ("HT") which essentially eliminates the olefins and the sulfur. They are quite stable in long-term storage. The octane rating on these products is only about 40 so the cetane rating should be very good.

The final "premium diesel" fuel of the present invention is exemplified by one of the above materials, and has a boiling range from 320° F. to 350° F. or up as high as 402° F. depending on the material used. Also, the Sol 142HT could be blended 50/50 with any of the other material listed above to give a boiling range of 320° F. to 402° F. This top boiling range could probably be increased up to 475 or 500° F. by blending with a straight run fraction having a higher boiling range with an end point in the 475 to 500° F. area. These blends will perform as a "premium" fuel if the products are hydrogen treated. It is possible that premium performance could be obtained without hydrogen treating by judicious selection of feed stocks, proper removal of sulphur and proper distillation to remove the heavy ends. However, it is very probable that a good product would be made better by the hydrogen treating.

Many advantages accrue from the use of the instantly disclosed diesel fuel to be used in emergency situations in conjunction with diesel motors employed to power electric generators.

1. Excellent long term storage stability.
2. A biocide content that would protect against the build-up of molds or bacteria.
3. Easy starting after a long period of no engine use.
4. Proper lubricity for reduced engine wear.
5. Adequate cetane index for the purpose intended
6. A gel or freezing point low enough for the climate where the fuel will be used.
7. A sulphur content low enough so that the exhaust will meet environmental concerns.

The "STAND BY™" formula of the present invention as defined herein meet these enumerated requirements and is a novel solution to the problem presented by the emergency use of existing diesel fuels.

The herein disclosed invention involves a method of operating a diesel engine powered electrical generator for emergency purposes during occasional or infrequent power outages, wherein the diesel engine is not used for extensive time periods, wherein the diesel engine is supplied by a reservoir tank of conventional diesel fuel, and wherein the conventional diesel fuel tends to deteriorate over relatively long time periods when the emergency generator is not required, such that the diesel engine may operate improperly or less efficiently when the emergency generator is required. The improvement of the present invention comprises the step of filling the reservoir tank with mineral spirits as the emergency diesel fuel instead of conventional diesel fuel for relatively short-term usage, thereby substantially eliminating the problem of fuel deterioration and possible engine malfunction over relatively long time periods of non-use. The emergency diesel fuel can be mineral spirits which have an aromatic content of up to approximately twenty-five percent (for example). The method further includes the step of providing a biocide in the mineral spirits. Preferably, the biocide is in the range of 500 to 1000 ppm. The Sol 142 HT (Shell's) mineral spirits has an autoignition temperature of around 452° F.

The alternative fuel of the present invention is applicable to all diesel engines which, typically, may be in the range of up to 3,000 HP (for example).

Viewed another way, this invention involves an emergency diesel motor for an electric generator which operates infrequently and in emergency situations and may be particularly difficult to start in cold weather comprising said diesel motor having a tank attached thereto for storing diesel fuel for said diesel motor, said tank containing a fuel selected from a member of the group consisting of mineral spirits, aliphatics, aromatics and mixtures thereof, said fuel having a low sulfur content, a flash point above 125° F., an autoignition temperature in the range of 445° F. to 465° F., will remain fluid at cold temperatures, and has a 90% distillation in the range of 350° F. to 450° F. producing efficient fuel vaporization and facilitates starting.

Because the alternative diesel fuel of the present invention has such a high flash point, it may be stored safely for relatively long periods of time, without deterioration, and shipped via conventional distribution channels (such as UPS) and this is another, and important, benefit of the present invention. For example, for the "high-end" residential customer or "low-end" commercial customer, the alternative diesel fuel of the present invention may be shipped in 5-gallon cans (using UPS or its equivalent) and stored safely adjacent to the diesel engine-powered electrical generator. These generators may be fixed installations (or else portable or transportable for camping, construction and other purposes) intended for intermittent use in the event of an occasional power outage (or where power is desired in remote locations). Some of the alternative diesel fuel of the present invention may be poured, initially, into the tank of the diesel engine (again, without concern for fuel deterioration) and additional alternative diesel fuel added to the tank, on an as-needed basis, by merely pouring out the contents of the additional 5-gallon cans. Problems of engine malfunction (due to fuel deterioration) are avoided, engine maintenance may be reduced, and fast engine starting may be assured by using the non-deteriorating alternative diesel fuel of the present invention.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. The method of operating a diesel engine powered electrical generator for emergency purposes during occasional or infrequent power outages, wherein the diesel engine is not used for extensive time periods, wherein the diesel engine is supplied by a reservoir tank of conventional diesel fuel, and wherein the conventional diesel fuel tends to deteriorate over relatively long time periods when the emergency generator is not required, such that the diesel engine may operate improperly or less efficiently when the emergency generator is required, the improvement which comprises the step of filling the reservoir tank with mineral spirits instead of conventional diesel fuel for relatively short-term usage, thereby substantially eliminating the problem of fuel deterioration and possible engine malfunction over relatively long time periods of non-use.

2. The method of claim 1, wherein the mineral spirits has an aromatic content of up to about twenty-five percent.

3. The method of claim 2, further including the step of providing a biocide in the mineral spirits.

4. The method of claim 3, wherein the biocide is in the range of 500 to 1,000 ppm.

5. The method of claim 1, wherein the mineral spirits has a flash point of at least 125° F.

6. The method of operating a diesel engine powered electrical generator for emergency purposes during occasional or infrequent power outages, wherein the diesel engine is not used for extensive time periods, wherein the diesel engine is supplied by a reservoir tank of conventional diesel fuel, and wherein the conventional diesel fuel tends to deteriorate over relatively long time periods when the emergency generator is not required, such that the diesel engine may operate improperly or less efficiently when the emergency generator is required, the improvement which comprises the step of filling the reservoir tank with a fuel for powering said diesel engine said fuel having, a) a flash point over 125° F., b) a 90% distillation in the range of about 350° F. to 450° F., c) a cetane rating in the range of about 40 to 60, and d) a low sulfur content in the range of about 1 to 5 ppm.

* * * * *